United States Patent [19]

Brooks et al.

[11] Patent Number: 4,967,844

[45] Date of Patent: Nov. 6, 1990

[54] SELECTIVELY OPERABLE BALL VALVE AND PRODUCTION PACKER SYSTEM

[75] Inventors: Robert T. Brooks; William T. Tapp, both of Yorktown, Tex.

[73] Assignee: Elder Oil Tools, Yorktown, Tex.

[21] Appl. No.: 344,671

[22] Filed: Apr. 28, 1989

Related U.S. Application Data

[63] Continuation-in-part of Ser. No. 330,749, Mar. 30, 1989, abandoned.

[51] Int. Cl.[5] ..... E21B 31/18; E21B 33/128; E21B 33/129; E21B 34/12

[52] U.S. Cl. ..... 166/381; 166/123; 166/138; 166/332; 166/386; 166/387; 285/86

[58] Field of Search ..... 166/138, 140, 123, 237, 166/387, 386, 382, 381, 330, 331, 332; 251/229, 352

[56] References Cited

U.S. PATENT DOCUMENTS

| | | | |
|---|---|---|---|
| 3,100,537 | 8/1963 | Crowe | 166/332 |
| 3,386,701 | 6/1968 | Potts | 251/352 X |
| 4,270,606 | 6/1981 | McStravick et al. | 166/331 X |
| 4,421,171 | 12/1983 | Haynes | 166/331 |
| 4,458,751 | 7/1984 | Haynes | 166/331 X |
| 4,576,230 | 3/1986 | Tapp et al. | 166/382 |
| 4,610,300 | 9/1986 | Mullins et al. | 166/410 X |
| 4,715,445 | 12/1987 | Smith, Jr. | 166/237 X |
| 4,844,154 | 7/1989 | Ross et al. | 166/237 X |

*Primary Examiner*—Stephen J. Novosad

[57] ABSTRACT

A system for installing and removing a production packer and ball valve apparatus in a well casing. The packer apparatus and valve apparatus are transported into a casing with an on/off overshot connected to a string of tubing. The packer is set by tubing manipulation independent of operation of the valve and the on/-off connector and is resettable and can be disabled by a straight upward pull on the tubing string. The valve apparatus is selectively operable by rotary manipulation of the tubing string through the disengageable overshot and utilizes rotary motion to rotate a ball valve element between open and closed positions of the ball valve. In one form of the invention, the overshot is rotatably disengageable from the ball valve while the ball valve is operated by rotation of the string of pipe. The ball valve apparatus is capable of withstanding pressure in opposite directions.

48 Claims, 7 Drawing Sheets

SELECTIVELY OPERABLE BALL VALVE AND PRODUCTION PACKER SYSTEM

Continuation-In-Part

This application is a continuation-in-part of the application Ser. No. 330,749 filed Mar. 30, 1989, now abandoned, by the same inventors for the same titled invention. The benefit of the earlier filing date is hereby claimed.

FIELD OF THE INVENTION

This invention relates to downhole production equipment for use in an oil well environment for selectively isolating fluid flow through a production packer or other downhole tubular device, and more particularly, relates to a system and component devices including a resettable production packer, a selectively operable ball valve and a selectively operable overshot or release mechanism for use in oil production operations.

DESCRIPTION OF THE PRIOR ART

In secondary oil field recovery operations which are conducted after primary oil field production operations have been discontinued, a typical process is to inject available salt water and/or gas into one or more injection wells. The injection wells are cased boreholes which traverse earth formations and extend from the earth's surface to a hydrocarbon production stratum located below the earth's surface. In an injection well, the salt water is injected under hydraulic pressure through a string of tubing to a perforated casing section located below a production packer. The pressured salt water is intended to flush residual oil or hydrocarbons in the stratum toward one or more producing wells located at a distance from an injection well. The producing wells thus produce the salt water driven hydrocarbons from the earth stratum.

The salt water usually has a high solid content and a high concentration of dissolved oxygen and creates a highly corrosive environment for the tubing string, the equipment and the casing in an injection well. The process also produces high pressures in the injection well equipment and in the earth stratum in the vicinity of an injection well. High pressures in the formations sometimes reverse the sale water through an injection well string of tubing because of over pressures in the earth stratum.

In the injection well, a wireline blanking plug can be used to seal off the tubing bore in the injection well at a location above or below the packer and thereby prevent flow of fluid in either direction. If a blanking plug is installed, the tubing string can be released from the packer and retrieved or pulled out of the well bore without pump or formation pressures being present. The tubing string is often retrieved for replacement or repair.

Downhole shutoff valves also have been developed for use in an injection well. The shutoff valve is coupled to a packer apparatus for sealing off the bore of the packer. A release mechanism or overshot on the end of a string of tubing or pipe permits release of the tubing string from the valve and retrieval of the tubing string from the well bore. Examples of such devices and pertinent prior art include U.S. Pat. No. 4,458,751; U.S. Pat. No. 4,210,207; U.S. Pat. No. 4,421,171; and U.S. Pat. No. 4,270,606.

The ball valves of the prior art disclose use of a spherical ball valve element, which in closed valve position, has seals which seal or close off the bore in the ball valve so that the valve element will seal against pressure in one or both directions. The valve element can be operated by rotation and/or axial movement of a tubing string to open and closed conditions. Rotation after operation of a valve is also used to release an overshot or release mechanism coupled to a ball valve. Thus, heretofore it has been necessary to operate the ball valve and the overshot release in sequential rotative operations and there is no positive indication that the valve is fully closed. Should the ball valve fail to fully rotate to a closed position or lock in a semi-open position, it is possible to rotatably release the overshot member while the ball valve is still open. U.S. Pat. No. 3,386,701 has structure related to the ball valve of the present invention.

Packers heretofore utilized have been set by up and down manipulation of a string of tubing. However, resetting of the packers has required rotatory manipulation of the latching mechanism. Further, the packers of the present invention utilize an emergency release mechanism which will operate on a straight upward pull of the tubing string. U.S. Pat. No. 4,576,230 has structure related to the present invention.

SUMMARY OF THE PRESENT INVENTION

The preferred form of the present invention involves a system which includes a disengageable overshot or release mechanism assembly which is releasably coupled to a ball valve and a production packer. The packer assembly includes inner and outer tubular assemblies which operate in response to an up and down motion of a tubing string for moving the outer tubular assembly to a contracted condition and setting a packer element and wall engaging slips in a well casing. The packer element is releasable through right hand rotation of the tubing string so that upon release of the packer element, the outer tubular assembly can be reset in an extended condition by a combination of left hand torque and longitudinal relative motion. Thus the packer can be reused at different production levels in a well bore. The outer tubular assembly has an emergency release means which permits release of the outer tubular assembly when the slips and the packing element are set in a casing. The emergency release can be made with a straight up pull on the tubing string.

The ball valve assembly has a ball valve operated upon a single left hand turn of the overshot assembly when the packer element is set in a well casing. In a preferred embodiment, the ball valve is actuated to move between an open and a closed position simultaneously with actuation or release of the overshot assembly by a left hand turn of tubing string. This is accomplished by screw threaded actuation of both the ball valve and the release mechanism in the overshot assembly. The ball valve has positive stops at the open and closed position so that the operator at the earth's surface has a positive indication that the valve has operated. When the ball valve is in a closed position, the release mechanism is simultaneously uncoupled.

The ball valve assembly is novel in construction and arrangement in that a rotatable ball valve element in the valve assembly is moved between positive stop conditions respectively in an open position and in a closed position by a single left hand turn of a string of well tubing. The actuator member for the rotation of the ball valve element is moved in a linear direction by a screw threaded connection between upper and lower stops for 0° to 90° rotation of the ball valve element.

DESCRIPTION OF THE INVENTION

Figure 1:
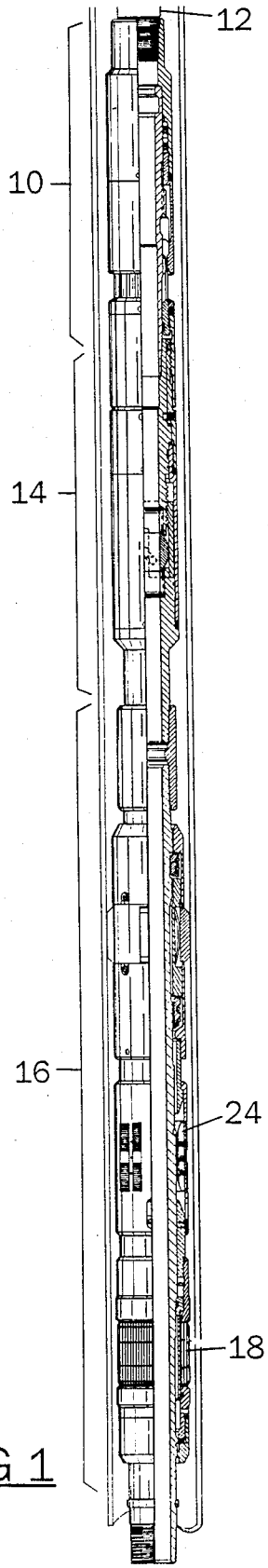
FIG. 1 is a longitudinal view of an assembly of tools which incorporate the present invention.
Figure 10:
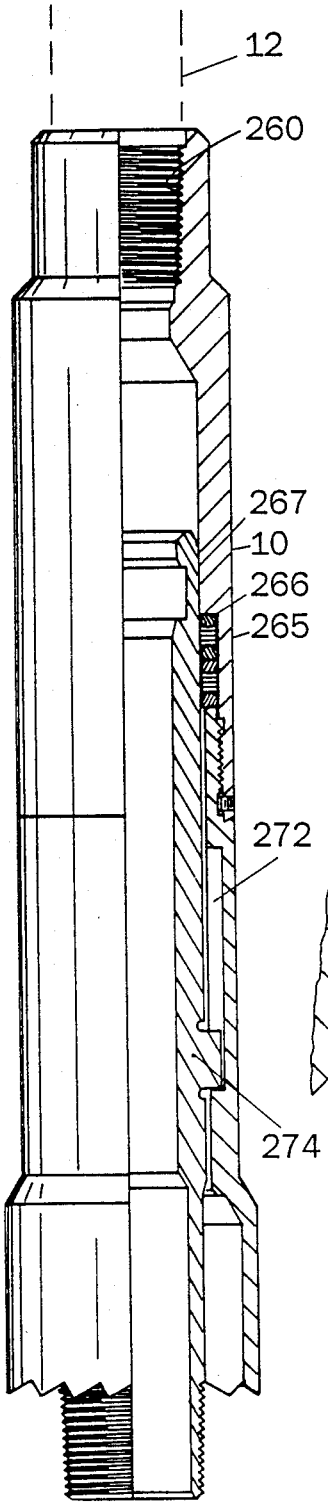
FIG. 10 is a view in partial longitudinal cross section of a conventional overshot assembly.
Figure 11:
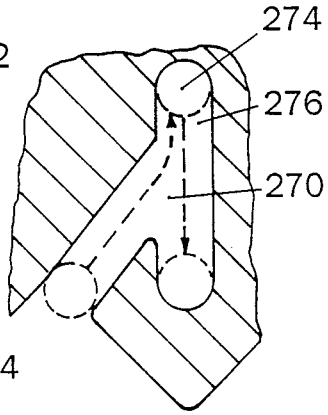
FIG. 11 is a plane view of a slot system for the tool shown in FIG. 10.

Referring now to FIG. 1, an overall assembly of system components is illustrated. A tubular overshot assembly 10 connected to the lower end of a string of tubing not shown (or tubing string) is releasably coupled to a ball valve assembly 14. A conventional form of a releasable overshot or release mechanism assembly is shown in FIGS. 10,11, while different embodiments of a novel releasable overshot assemblies are respectively shown in FIGS. 12–15 and FIGS. 16–18.

A basic ball valve assembly 14 of the present invention shown in FIGS. 6–9. In FIGS. 6–9, the ball type shutoff valve assembly 14 is constructed for operation between positively located open and closed stop positions, or between on and off flow conditions, by rotative movement of the string of tubing which produces a linear motion of an actuator member between fixed stop positions in the ball valve assembly 14.

In FIGS. 12–15 and FIGS. 16–18, preferred forms of overshot and ball valve assembly are illustrated where the ball valve element is operated by linear motion of an actuation member and a co-extensive rotative operation of the attached overshot assembly releases a threaded collet connection of the overshot assembly to a ball valve assembly only when the ball valve element is in a closed position.

As shown in FIG. 1, the lower end of the ball valve assembly 14 typically is connected to a production packer assembly 16. The ball valve assembly 14 and the packer assembly 16 are constructed and arranged so that the assemblies may be selectively operated by manipulation of the string of tubing 12 and the attached overshot assembly 10. A packer element 18 and slip elements 24 on the packer assembly are arranged to be extended into sealing contact with a well casing with left hand rotation followed by an up/down motion of a tubing string and can be retracted from the well casing by right hand rotation of the tubing string. In all instances of operation the production packer is the first assembly set in a well bore.

For convenience of under standing, the manipulative operations for the assemblies include:

SET PACKER, OPERATE VALVE, RETRIEVE TUBING (a) to set the packer element 18 and slip elements 24 on the packer assembly 16 in an expanded and contacting relationship with the casing:

(1) lower or set down on the tubing string 12 and torque left (counterclockwise) for three-fourths ($\frac{3}{4}$) turn or more; now raise or pull up on the tubing string 12;

(b) to close a normally open ball valve in the valve assembly 14 after the packer assembly is set:

(1) lower the tubing string 12 and rotate left (counterclockwise) until the ball valve in the assembly 14 rotates to a closed position;

(c) to release or remove a conventional overshot assembly 10 from a closed ball valve (see FIG. 10):

(1) pick-up or raise the tubing string, torque to the left, lower the tubing string while torquing left and then pull up;

RECONNECT TUBING, OPERATE VALVE, UNSEAT PACKER (a) to reconnect a conventional overshot assembly 10 (see FIG. 10):

(1) stab the overshot assembly onto the upper end of the ball valve assembly 14; pick up to establish latching on;

(b) to open the ball valve in the ball valve assembly 14:

(1) rotate tubing string to the right (clockwise) while slacking off on the tubing string which rotates the ball valve to an open position;

(c) to unseat the packer assembly 16 and return it to its initial condition:

(1) rotate tubing string to the right (clockwise) while slacking off on the tubing string to place the packer assembly 16 in its initial condition where the slip elements and the packer elements are retracted.

EMERGENCY RELEASE OF PACKER (a) for an emergency release of the packer assembly 16, pull straight up on the tubing string 12;

SIMULTANEOUS VALVE OPERATION AND RELEASE OF TUB

The novel overshot assemblies shown in FIGS. 12–14 and FIGS. 15–17 are constructed and interconnected so that after setting the packer assembly with right hand rotation:

(a) to release the novel overshot assembly from a ball valve assembly 14 and to operate the ball valve simultaneously;

(1) rotate the tubing string to the left (counterclockwise) which rotates the ball valve element to a closed condition and stop position and contemporaneously rotates a release mechanism in the novel overshot assembly to a releasing condition at the same time the ball valve element reaches the stop position.

THE PACKER ASSEMBLY

Figure 2:
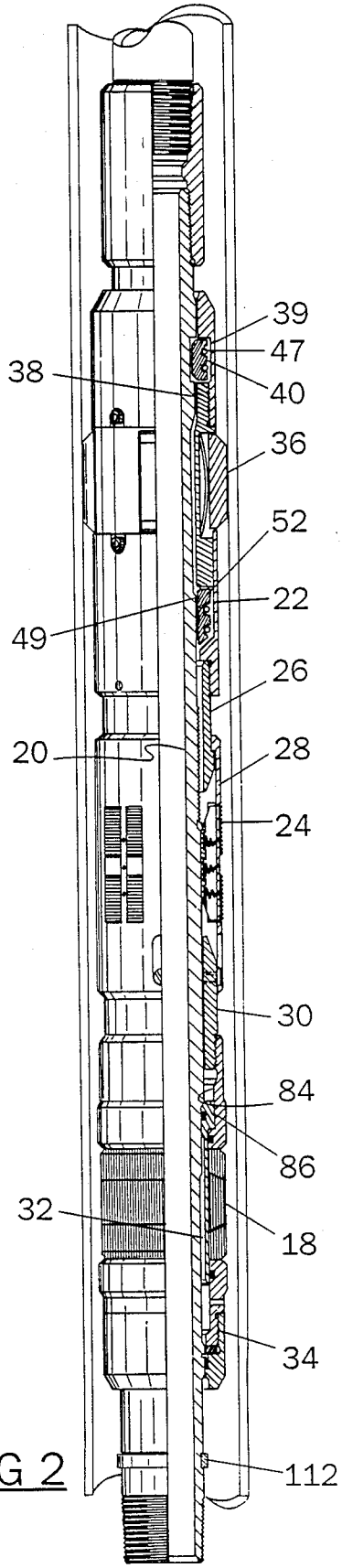
FIG. 2 is a longitudinal view in partial cross section of a novel packer construction which can be set and reset and can be emergency retrieved if necessary with a straight upward pull on a string of tubing.

The production well packer assembly 16 of the present invention (see FIG. 2) consists basically of a one piece, elongated, tubular inner mandrel member 20 which receives a tubular outer assembly 22 of interconnected and relatively movable component elements or members. The outer assembly 22 includes the slip members 24 for selectively engaging the wall of a pipe member or casing (shown in FIG. 2) and the packer element 18 which is expandable into sealing engagement with a well casing. The outer assembly 22 of component element from top to bottom as illustrated in FIG. 2 also includes a tubular upper expander member 26, a tubular slip cage member 28, a tubular lower expander member 30, a tubular packer support member 32 for the packer element 18 and a tubular lower packer collar element 34. The packer support member 32 underlies the length of the packer element 18 and is slidably and sealingly received within the collar element 34 and within the lower expander member 30 where the lower cone and the upper gauge ring are considered as one unit.

Figure 4:
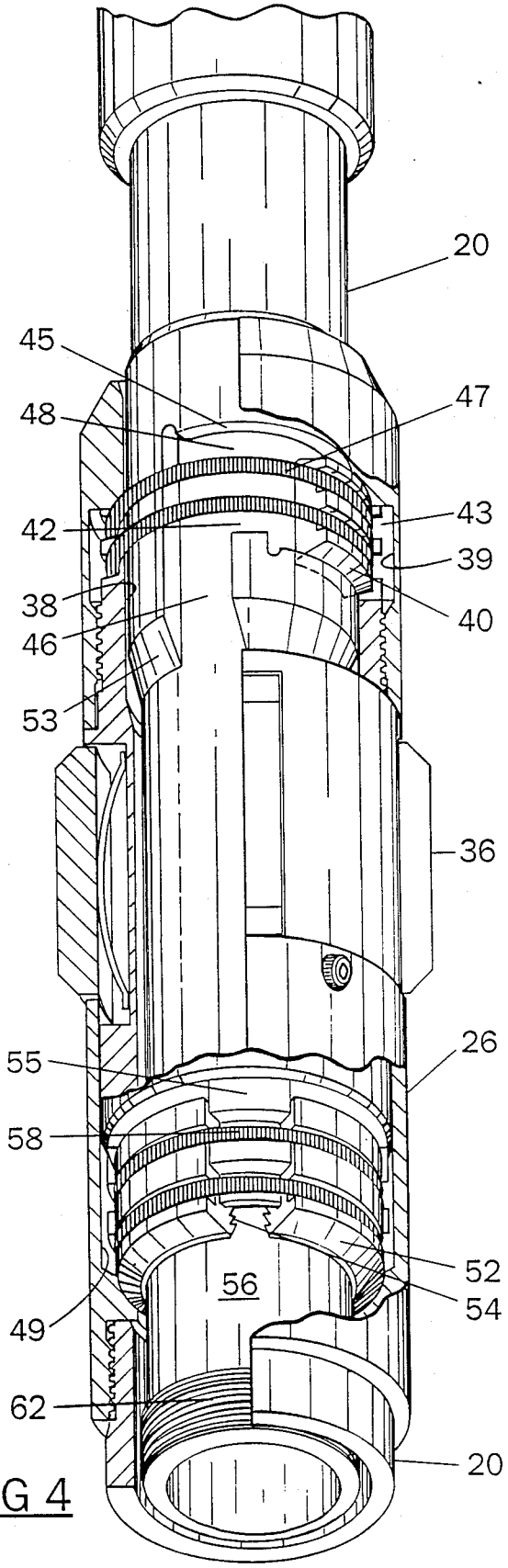
FIG. 4 is a perspective view in partial cross section of a locking system used in the packer.
Figure 7:
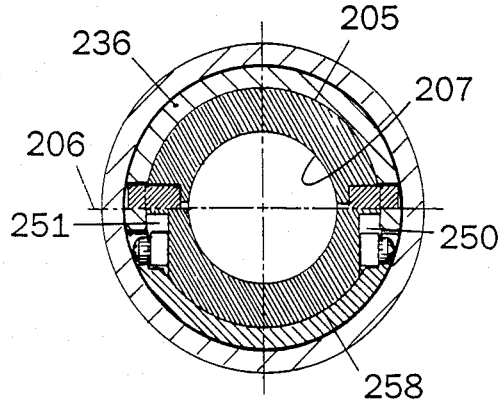
FIG. 7 is a view in cross section taken along line 7—7 of FIG. 6.
Figure 8:
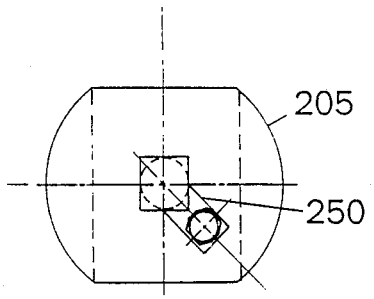
FIG. 8 is a view of the ball valve element and the slot for rotating the ball valve element.

The upper expander member 26 also has several friction pad elements 36 where the friction pad elements are equiangularly positioned about the outer circumference of the upper expander member 26 in a well known manner and resiliently, as well as frictionally, engage the wall of a casing (as shown in FIG. 2) so as to frictionally retard movement of the upper expander member 26 relative to a casing. In the bore 38 of the upper expander member 26 see FIG. 4) at a location above the friction pad elements 36 is a pocket or annular recess 39 which slidably receives a lug member 40. (See FIG. 4). The lug member 40 is retained within the recess 39 in co-rotative relation with the upper expander member 26 by a lock key 43 and is normally resilient biased inwardly into contact with the inner mandrel member 20 by biasing annular spring members 47.

Figure 5:
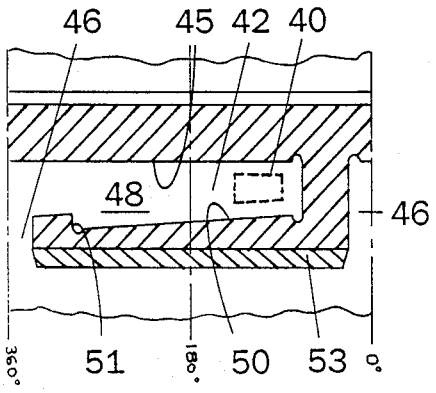
FIG. 5 is a view on a surface plane of the circumference of the mandrel member to illustrate a slot and lug system.

In the outer wall of the inner mandrel member 20 (as shown also in FIG. 4 and FIG. 5), is a slot system 42 formed by a vertically arranged slot 46 which is connected to a circumferentially disposed lateral transfer slot 48. In the position shown in FIGS. 2, 4 & 5 while the well packer assembly 16 is being moved downwardly through a well casing, the friction pad elements 36 on the upper expander member 26 are in engagement with the well casing and the drag of the friction pad elements on the casing will maintain the lug member 40 in the upper expander member 26 in a contact position where the lug member 40 engages a downwardly facing end surface 45 in the circumferentially disposed lateral transfer slot 48. In FIG. 5, the enlarged diameter portion in which the transfer slot 48 is formed is shown with cross hatch for case of illustration. FIG. 5 is a development plan view of the circumference of the inner mandrel member 20.

As shown in development plan view in FIG. 5, the transverse slot 48 has a lower edge surface 50 inclined at a preferred angle of 5° relative to a transverse plane. The lug member 40 has a co-operating lower face at an angle equal to that in the transverse slot 48. To release the lug member 40 from the transverse slot 48, the operator lowers the string of tubing 12 and the inner mandrel member 20 is thus lowered and brings the upper edge surface 45 of the transfer slot 48 into engagement with the lug member 40 on the upper expander member 26. The operator rotates or turns the inner mandrel member 20 to the left (or counterclockwise) by torquing the string of tubing 12 to bring the lug member 40 into registry with the vertical slot 46. With the downwardly extending vertical slot 46 in registry with the lug member 40, an upward pull on the string of tubing 12 moves the lug member 40 from the transverse slot 48 and through the vertical slot 46 to a location where the lug member 40 is not constrained by the slot system 42 and to a position on the inner mandrel member 20 below the slot system 42. So long as the lug member 40 is below an inclined surface 53 on the inner mandrel member 20, the inner mandrel member 20 is longitudinally and rotatively manipulable relative to the upper expander member 26. Relative movement of the inner mandrel member 20 is permitted because the friction pad members 36 retain the upper expander member 26 relatively fixed to the casing.

Below the friction pad members 36 is an internal annular pocket 49 located about the inner circumference of the upper expander member 26. The annular pocket 49 contains annularly shaped locking nut segments 52 which are co-rotatively coupled to the upper expander member 26 by castellate locking members 55 see FIG. 4) and respectively have internal buttress type right hand locking threads 54 which initially bear upon the outer surface 56 of the inner mandrel member 20. The locking nut segments 52 are normally biased inwardly into contact with the inner mandrel member 20 by annular garter springs 58 in a well known manner.

The tubular inner mandrel member 20 has a span or length of buttress thread type right hand locking threads 62 initially located below the locking nut segments 52 in the initial position of the inner mandrel member 20 relative to the expander member 26. When the inner mandrel member 20 is released from the upper expander member 26, and moved upwardly relative to the upper expander member 26, the locking threads 62 on the inner mandrel member 20 engage the locking threads 54 on the locking nut segments 52 and prevent the tubular inner mandrel member 20 from moving downwardly relative to the upper expander member 26. To urge the locking nut segments 52 to lock positively down on the buttress type, right hand locking thread forms 62 and the angled face on the lower end of the locking nut segments 52 co-operatively engage with a mating angled face at the lower end of the annular pocket 49 to force the locking nut segments inwardly as the load is transmitted downwards through the inner mandrel member 20.

Referring again to FIGS. 2 and 3, at the lower end of the upper expander member 26 is an annular, outwardly facing frusto-conical expander surface 64 for engagement with complementary, inwardly facing frusto-conical expander surfaces 66 on the slip elements 24. The slip elements 24 are elongated and equiangularly disposed about the inner mandrel member 20.

Figure 3:
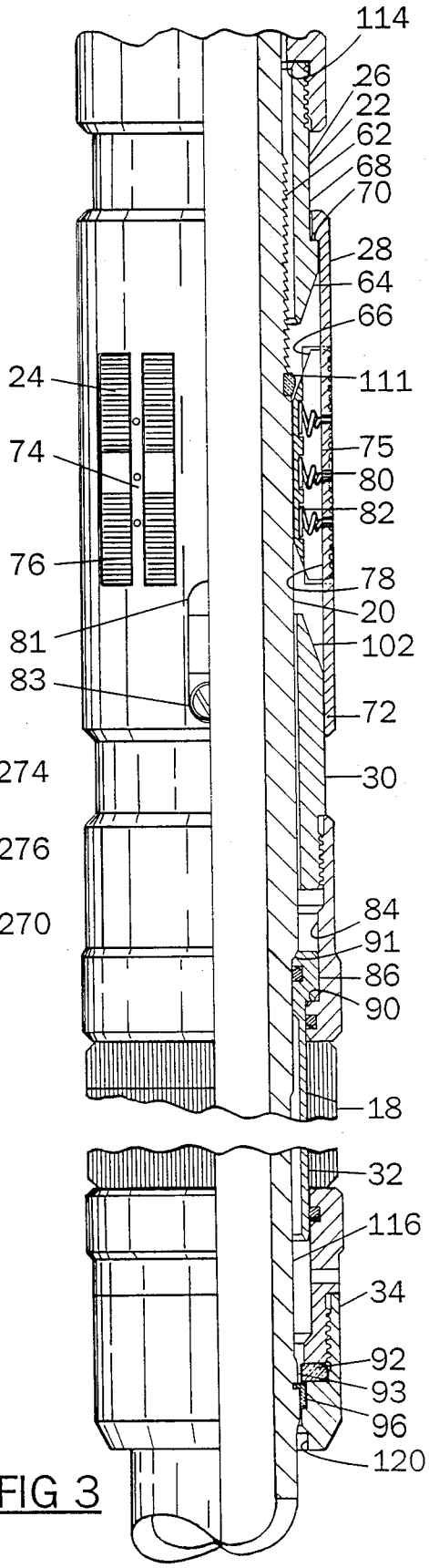
FIG. 3 is a partial view enlarged in cross section for two sections of the well packer of FIG. 2.

As shown in enlargement in FIG. 3, the outer surface of the upper expander member 26, at a location above the inclined expander surface 64, has an annular outer recess 68 which slidably receives an annular, inwardly extending, annular flange element 70 seated on the upper end of tubular cage member 28. The tubular cage member 28 has a lower annular portion 72. Intermediate of the length of the cage member 28 are side by side vertical slots which are separated by a vertical strap portion 74. The strap portions 74 and the slots are equiangularly spaced about the circumference of the cage member 28 to locate the slip members about the circumference of the tool. Each strap portion 74 extends through a longitudinal, mid-section groove or slot 75 in a slip element 24 to retain the slip element in position yet permit the slip element to move radially inwardly and outwardly relative to the cage member 28 and the mandrel member 20. Each slip element 24 includes outer serrated surface portions 76 for engagement with a casing wall, as well as the upper, inwardly facing inclined surface 66 and a lower, downwardly facing inwardly inclined surface 78. Conical shaped coil spring means 80 are provided in the slot 75 in each slip element 24 and located between a strap portion 74 and a bottom surface 82 of a slot 75 in a slip element 24 to normally resiliently bias a slip element 24 to a retracted position against the outer surface of inner mandrel member 20.

The lower portion 72 of the cage member 28 is slidably received on the outer surface of the lower expander member 30. A locking circularly headed screw 83 is attached to the lower expander member 30 and slidable in a vertical slot 81 to permit the lower expander member 30 to move or slide upwardly relative to the cage member 28 and to limit downward relative movement of the lower expander member 30 relative to the cage member 28.

The lower expander member 30 has an internal annular recess 84 which slidably receives a flange 86 on a tubular packer support member 32. The flange 86 on the packer support member 32 engages a downwardly facing shoulder 91 on the inner mandrel member 20 which limits upward relative movement of the packer support member 32 relative to the inner mandrel member 20. The tubular packer support member 32 provides an internal support for length of the packer element 18 and extends to the lower packer collar member 34 in which it is slidably and sealingly received.

As shown in FIG. 3, the lower packer collar member 34 has an internal and annular bearing means 92 which rotatively support an outer surface 93 of the tubular inner mandrel member 20. This is particularly important to provide for centralization of the mandrel member 20. Annular shear ring, "C" shaped shear elements 96 are disposed in a location between the bearing means 92 and the tubular mandrel member 20 to releasably lock the tubular inner mandrel member 20 to the lower packer collar member 34 yet permit rotation. The tubular inner mandrel member 20 has an annular release ring or flange 112 on its outer surface see FIG. 2) which is located below the lower packer element 18 for a purpose which will be explained hereafter. The bearing 92 also acts on top face of the shear elements 96 during rotational release to reduce friction load.

From the foregoing description, it can be appreciated that when the well packer assembly 16 is transported through a well casing, the inner mandrel member 20 is rotatively and longitudinally locked in place relative to the upper expander member 26 by the locking lug member 40 in the transverse slot 48 while the lower packer collar member 34 is longitudinally held in place by the annular locking ring 96 which couples the inner mandrel member 20 to the lower collar member 34. In this condition, all of the members or elements in the outer packer assembly are in a stretched-out or in an extended condition while going through the well casing. The downwardly facing flange 91 on the flange 86 co-operates with an upwardly facing surface 90 in the annular space 84 to cause the lower expander member 30 to stretch out and to lock the slip element 24 in a retracted position. When the well packer assembly 16 is in position to be set, the operator lowers the tubing string while turning left, which releases the locking lug member 40 from a locking position in the recess 42 and locates the lug 40 into registry with the vertical slot 46. Next the operator raises the tubing string which permits the tubular inner mandrel member 20 to move upwardly relative to the outer expander member 26 (which is held by the friction pad members 36 in a relatively stationary position in the casing). The tubular inner mandrel member 20 while moving upward carries along with it the lower packer collar member 34, the packing element 18 and the lower expander member 30 moves to a position of engagement with slip members 24 transmitting the cage member 28 and slip members 24 upwardly while the spring members 80 prevent the slip elements from moving outward. The slip elements 24 are moved upwardly with the cage member 28 until the slip members 24 engage the upper expander member 26. Continued upward movement of the inner mandrel member 20 moves the cage member 28 upwardly relative to the upper expander member 26 and the surfaces of the slip elements 24 and the expanders engage and move the slip elements 24 outwardly into contact with the casing. At this time the locking threads 62 on the tubular inner mandrel member 20 are in ratchet threaded engagement with the locking threads 54 on the nut members 52 which prevent downward movement of the mandrel member 20 relative to the slip elements 24. A subsequent downward movement of the inner tubular mandrel member 20 by slacking off on the drill pipe or string of tubing will securely wedge the slip elements 24 on the upper and lower expander surfaces 66, 78 to tightly engage the slip elements 24 in engagement with the wall of the casing so that both the upper and lower inclined surfaces 66, 78 of the slip elements 24 are engaged by the expander surfaces 64, 102.

After the slip elements 24 are set, an upward pull on the tubular inner mandrel member 20 will cause the lower packer collar member 34 to move upwardly relative to the lower expander member 30 and to compress and expand the packing element 18 into a sealing engagement with the well casing. The mandrel locking threads 62 in engagement with the locking threads 54 maintain the tubular inner mandrel member 20 in the uppermost position achieved in setting the packing element.

Subsequently, to retrieve or reposition the well packer 16 in another location in the well bore, the inner mandrel member 20 is rotated in a right hand or clockwise direction with inner mandrel member 20 in the vertical or set down weight position, so that the right hand threaded section on the inner mandrel member 20 with threads 62 unscrews out of the threads 54 of the locking nuts 52. (See FIG. 4). In this process, the inner mandrel member 20 moves downwardly relative to the fixed slip elements 24 and the friction held upper expander member 26. In moving downwardly, the lower collar element 34 on inner mandrel member 20 moves downwardly and relaxes or unseats the packer element 18 from the well casing; the shoulder 91 on the inner mandrel member 20 maintains the packer support sleeve portion 32 under the packer element 18; the flange 86 of packer support element 32 engages the upward facing recess shoulder 90 and moves the lower expander member 30 downwardly which disengages the lower expander member 30 from the slip members 24; the pins 83 on the lower expander member 30 engage the lower end of the slot 81 in the cage member 28 and the slip elements 24 are disengaged from the upper expander member 26; and finally, the threads 62 and 54 clear one another and the outer packer assembly 16 assumes the initial position shown in FIG. 2 of the drawings. In moving downward, the inner mandrel member 20 has its inclined annular surface 53 (see FIGS. 3,4) located just below the recess 39. Irrespective of its position, the locking lug 40 is moved transversely or radially outward into the recess in the inner mandrel member 20 so that the lug 40 rides over the outer surface on the inner mandrel member 20 until it reaches the slot 48 where it moves radially inward to be automatically reset in the slot 48. The spring members 47 resiliently urge the lock member 40 toward the inner mandrel member 20. The well packer assembly can then be repositioned and reset in the well casing or removed from the well casing.

To retrieve the packer assembly 16 in the event of a malfunction, the inner mandrel member 20 can be picked straight up while the packer element 18 and slip elements 24 are set. While the packer is set, at a predetermined shear force, the ring member 96 (FIG. 3) will shear which permits the annular pickup shoulder 111, (see FIG. 3) located on the tubular inner mandrel member 20 above the slip members, to engage an internal flange 114 in the upper expander member 26 to thereby move the upper expander member 26 in an upward direction. The pickup shoulder 111 is located in a position below the threaded portion 62 on the inner mandrel member 20 and initially is located just above the upper part of the slip elements 24. When the pickup shoulder 111 engages the flange 114 in the upper expander member 26 and moves the upper expander member 26 upward, the upper expander member 26 engages the annular flange element 70 on the cage member 28 to disengage the slip element members 24 from the lower expander member 30. The cage member 26, in turn, pulls the lower expander member 30 by the pin 83 to pull on the packing support member 32 under the packer element 18 and to release the packing element 18. The packing support member 32 is then located over an annular recess 116 on the inner mandrel member 20 where the inner recess 116 is longer than the length of the support member 32 thereby providing fluid bypass. The lower retainer ring 112 on the inner mandrel member 20 is sized to be received in a lower annular internal recess 120 in the lower collar member 34 to pick up the collar member 34, thus the entire outer assembly can be deactuated by a simple pick up on the tubing string 12.

THE BALL VALVE ASSEMBLY

A shut in ball valve embodying the invention in a ball valve is illustrated in FIGS. 6–9. The ball valve assembly 14 includes an outer tubular housing 200 which includes a tubular lower member 201, an intermediate member 202 and an upper cap member 203. The lower member 201 is normally attachable to a production packer assembly 16 as described in respect to FIG. 2. In any event, operation of the ball valve assembly 14 requires the lower member 201 to be stationary relative to an upper inner member 204. In the lower member 201 is a ball valve element 205 with spherical surface portions which can be sealed against pressure in either direction in a closed condition of the valve. The ball valve element 205 is rotatable about a rotational axis 206 between open and closed positions by rotation of the tubular inner member 204 which is releasably attached at its upper end to an overshot device. (See FIG. 10). The rotational axis 206 is transverse to the longitudinal axis of the housing member 201. In an open position of the valve element 205, the bore 207 of the ball valve element is full opening with respect to the passageway through the housing 200.

The tubular inner member 204 has an outwardly extending annular flange portion 208 located intermediate of its length and the flange portion 208 is disposed between bearing plate members 210,211 located in an annular recess 212 in the upper cap member 203. The bearing plate members 210,211 are made of beryllium copper or the like. Above and below the flange portion 208 are annular recesses 218 and 219 which are located in the tubular inner member 204. The recesses 218, 219 respectively contain an annular plastic based bearing and centralizing ring to prevent debris from access to the bearing plate members 210,211 and the flange portion 208.

At the lower end of the tubular inner member 204 is an outer threaded portion 224 with a multiple left hand thread. The threaded portion is a four start thread which permits a 90° rotation of the ball valve element with one turn of the inner member 204. This is the preferred embodiment of the design although a single start left or right hand thread could be utilized. In the bore 226 of the lower end of the inner member 204 is an inner annular recess which receives an annular sealing element 228. The sealing element 228 is constructed from metal and is resiliently urged downwardly into sealing contact with an outer spherical surface on the ball valve element by means of flat annular spring members 230. An annular elastomer element 232 on the sealing element 228 also sealingly contacts the outer spherical surface of the ball valve element 205. An 0-ring type seal sealingly contacts between the annular groove on the sealing element 228 and the inner annular recess at the lower end of the bore of the inner member 204.

Figure 6:
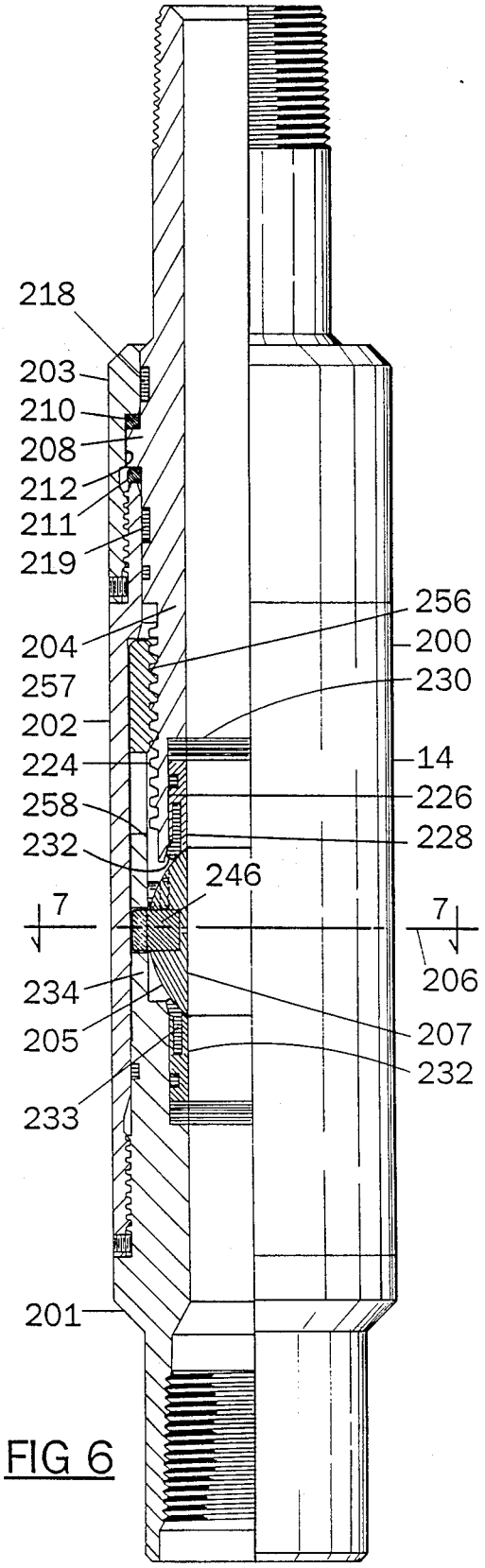
FIG. 6 is a view in partial longitudinal cross section of a ball valve embodying an invention.
Figure 9:
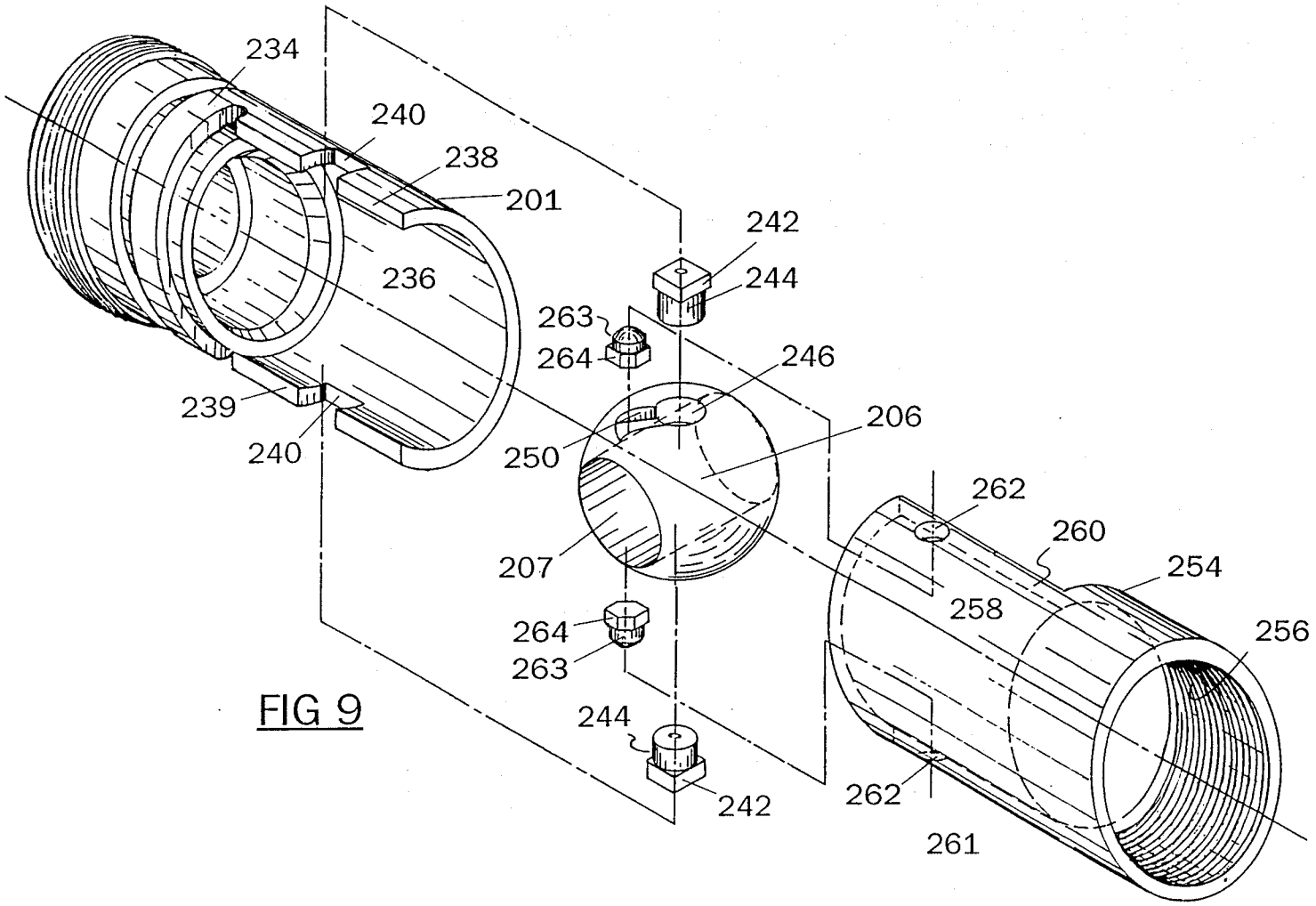
FIG. 9 is a perspective view of a ball valve embodying an invention.
Figure 14:
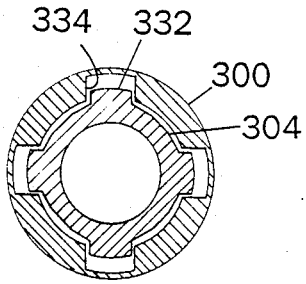
FIG. 14 is a view in cross section taken along line 14—14 of FIG. 12.
Figure 13:
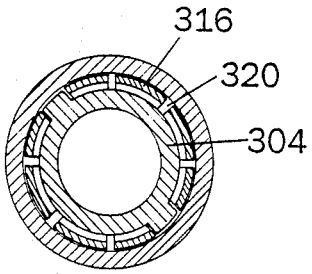
FIG. 13 is a view in cross section taken along line 13—13 of FIG. 12.

The tubular lower member 201 as shown in FIGS. 6 and 9 includes a tubular base portion 234 and an upper partial or cylindrically segmented wall portion 236 (see FIG. 9) which extends circumferentially through an angle slightly more than 180° and has vertical side surfaces 238,239. Intermediate of the length of the partial cylindrical wall portion 236 in the vertical surfaces 238,239 are rectangular and diametrically opposed positioned slots 240 which respectively are partially open on one side. Received in each of the slots 240 is a fitted rectangular base member 242 which has a transverse pivot pin portion 244 arranged to be received within a blind pivot bore 246. The bores 246 are formed at diametrically opposed locations on the ball 205 along the axis of rotation. The axes of the pivot pin portions 244 are coincident with the diametrical rotational axis 206 of the ball valve element 205. The base members 242, when seated in the slots 240 in the lower housing 201, pivotally mount the ball valve element 205 for rotation about the diametrical rotational axis 206 so that the ball valve element 205 may be positioned to provide a through or open passageway with its bore 207 in alignment with the bores of the upper and lower sealing elements 228,232 and alternatively, so that the ball valve element 205 may be rotated about the axis 206 of the pivot pin portions 244 to a position where the spherical surfaces of the ball valve element 205 close off the bores of the upper and lower sealing elements 228,232. The lower sealing element 232 is similar to the upper sealing element 228 and includes a similar cylindrical metal member 232 which is spring biased into contact with the lower spherical surface of the ball valve element 205 and has an outer annular and similar elastomer sealing element 233. The sealing element 232 also has an 0-ring seal similar to the sealing element 228. Thus the valve structure includes upper and lower sealing elements 228,232 which will seal against pressure in either direction against the ball valve element 205 when the ball valve element is in a closed position.

To rotate the ball valve element 205 between an open position shown in FIG. 6 to a closed position, the ball valve element 205 is provided with angular drive slots 250, which are located in the outer surface of the ball valve element 205. The angular slots 250,251 are disposed parallel to and at an angle of 45° with respect to the longitudinal central axis of the bore 207 of the ball valve element. The angular slots are rectangular in cross section and extend along the outer surface of the ball valve element 205 from the blind pivot bores 246 located on the ball valve element.

A tubular actuating sleeve 254 is provided where the sleeve 254 is located between the threaded outer portion 224 of the inner mandrel member 204 and the inner wall of the intermediate tubular housing member 202. The actuating sleeve 254 has an upper tubular internally threaded portion 256 and a lower partial or cylindrically segmental wall section 258 (see FIG. 9) where the partially cylindrical section extends through an angle of less than 180° to vertical end surfaces 260,261 (see FIG. 9). The segmental wall section 258 has oppositely positioned pin bores 262 which rotably receive pin members 263. The pin members 263 have rectangular shaped drive members 264 projecting into sliding engagement with the angular slots 250 in the ball valve element 205. By moving the drive pins 264 in a vertical direction, the ball valve element 205 is rotated about the rotational axis 206 between an open and a closed position. The drive pins 264 rotate in the bores 262 and the pin members 263 in the actuating sleeve 254 are moved vertically and prevented from relative rotation by virtue of the fact that there is an inter-engagement of the side edge surfaces 260,261 on the partial cylindrical wall of the actuating sleeve 254 with the side edge surfaces 238,239 of the partial cylindrical wall on the portion 236 of the lower housing member 201 so that the actuating sleeve 254 may slide vertically upwardly and downwardly relative to the lower portion 236. To move the actuating sleeve 254 upward and downwardly, the internal threads of sleeve section 256 engage the externally threaded portion 224 on the tubular inner member 204 so that when the inner member 204 is rotated, the actuating sleeve 254 will move longitudinally relative to the housing member 202 by virtue of the threaded interconnection thereby pivoting the ball valve element 205 between open and closed positions. The threaded connection is left handed so that left hand rotation of the tubular string and the inner member 204 rotates the valve element 205 from an open to a closed position.

An important feature of this ball valve is the relationship of the vertical travel distance of the actuating sleeve 254 in the outer housing member 202. In the full open position of the ball valve element 205, shown in FIG. 6, the sleeve 254 engages a downwardly facing shoulder 257 in the housing member 202. When the sleeve 254 travels downwardly to rotate the ball valve element 205 (90° of rotation) to a closed position, the sleeve 254 engages an upper end 258 of the lower member 234 and the rotation of the inner member 204 is stopped. Thus, there is a positive indication of the closing or the opening of the ball valve element when the sleeve 254 reaches one of the stop shoulders.

CONVENTIONAL OVERSHOT

Now, referring to FIGS. 10 and 11, a conventional overshot assembly 10 is affixed by means of threads 260 to the lower end of the tubing string 12. The overshot assembly 10 is generally comprised of an outer housing unit 265 which defines a longitudinally extending overshot member.

The outer housing unit 265 has an elastomeric seal assembly 266 within an annular groove on the housing unit 265 which prevents fluid communication between the outside of the housing unit 265 and the bore of the upper end 267 of the inner member 204. The seal assembly 266 prevents fluid communication between the inner member (not shown) and the overshot assembly 10.

Now referring to FIG. 11, a slot assembly 270 is defined around the interior bore 272 of the overshot assembly 10 for receipt of a slot pin 274 located on the inner member 204. The packer assembly and ball valve assembly are run in the casing and the packer element is set in a manner known to the art. At any time the tubing string is to be retrieved, rotation to the left closes the ball valve in the ball valve assembly. Then, the tubing string is set down so that the pin 274 travels in to an upper slot portion 276. By applying additional torque to left and raising the tubing string, the pin 274 exits from the slot 270.

ROTATIVELY RELEASABLE OVERSHOT

Figure 12:
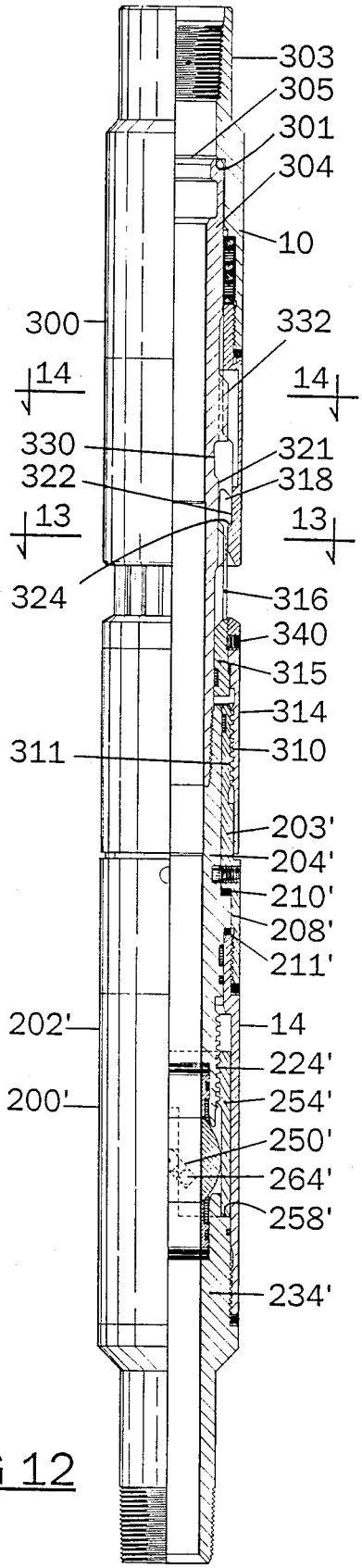
FIG. 12 is a view in partial cross section of a ball valve and overshot assemblies for simultaneous operations.
Figure 15:
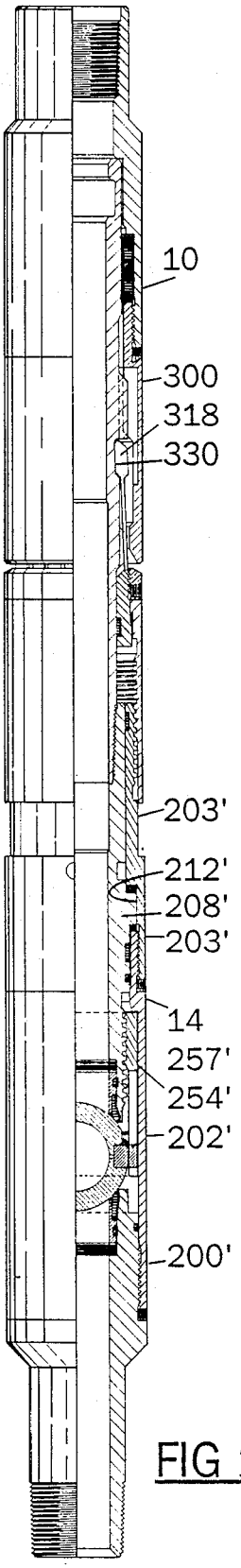
FIG. 15 is a view similar to FIG. 12 but showing the valve in a closed position.
Figure 18:
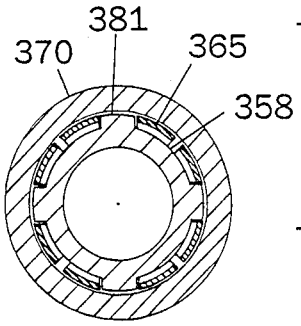
FIG. 18 is a view in cross section taken along line 18–18 of FIG. 16.
Figure 17:
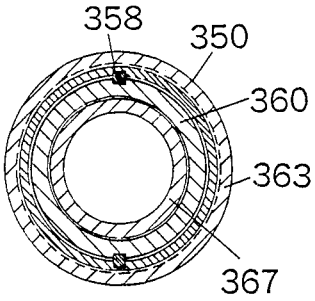
FIG. 17 is a view in cross section taken along line 17—17 of FIG. 16.

The rotatively releasable overshot of the present invention is arranged, through left hand rotation of the tubing string, to simultaneously operate and close the ball valve in a ball valve assembly while being released from connection with the ball valve assembly. As shown in FIG. 12, the lower end to a tubular ball valve housing 200' is attachable to a well packer and is relatively immovable when the well packer is set in the casing. (Similar parts with similar functions bear the same numeral together with a "prime" mark.) Coaxially received within the ball valve housing 200' is a tubular actuating inner member 204' with an outer left hand thread portion 224' in engagement with a threaded portion of a tubular ball driver or actuating sleeve member 254'. The ball driver or actuator sleeve member 254' has oppositely located, inwardly projecting drive members 264' which are slidably received in angular slots 250' in the ball member. The ball element is shown in an open position with the sleeve member 254' in a lower position in abutting relation to an upwardly facing shoulder 258' on the lower member 234'. Upon vertical upward movement of the sleeve member 254', the drive pins 264' in the angular slots 250' rotate the ball valve element 205' between an open and a closed position. As shown in FIG. 15 in the closed position, the sleeve member 254' engages a downwardly facing shoulder 257' in the intermediate housing member 202'. The sleeve member 254' is moved longitudinally relative to the housing 200' by left hand rotation and the sliding inter-engagement of the member 254' and lower housing member 234'. The ball valve assembly is basically constructed as previously described with respect to FIGS. 6–9. The tubular actuating sleeve inner member 204' of the ball valve assembly is mounted with a flange 208' located between bearing members 210',211' in an annular recess 212' within a tubular upper cap member 203'. The rotatable inner actuating sleeve member 204' extends upwardly and is received internally within a tubular overshot assembly 300.

The tubular overshot assembly 300 is connected to a tubing string for rotation and manipulation therewith. In the position shown in FIG. 12, the overshot assembly 300 has an internal downwardly facing shoulder 301 in an overshot housing member 303 which is in engagement with an upwardly facing shoulder 305 on the inner release sleeve member 304. The sleeve member 304 is threadedly coupled to the inner member 204'. While going in the well bore, the overshot housing member 303 is positively engaged and locked to engage the tubular release sleeve member 304.

At the upper end of the upper member 203' is an externally threaded portion 310 which threadedly engages an internal thread 311 on an upper tubular collar member 314. The tubular collar member 314 is attached to a tubular collet member 315 having upwardly extending finger members 316 which are provided with enlarged locking members 318. The finger members 316 are received in lengthwise extending slots 320 located diametrically opposed about the circumference of the inner release sleeve member 304 so that the finger members 316 are co-rotatable with the rotatable member 304. The enlarged locking members 318 are disposed between an outer surface 321 of the inner sleeve member 304 and the inner surface 322 of the overshot member 300 in a position where the locking members 318 are in engagement with an upwardly facing shoulder 324 on the overshot member. Thus, the overshot member 300 cannot move upwardly relative to the locking members 318 in the position illustrated in the drawing.

Just above the locking members 318, the inner sleeve member 304 has an internal annular recess 330 which can receive the locking members 318 and permit release of the locking members 318 from the shoulder 324 in the overshot member 300 so that the overshot member can be retrieved or released from the actuating sleeve 304. Just above the annular recess 330, the sleeve member 304 has circumferentially arranged, lengthwise extending spline members 332 which are slidably engageable with longitudinally extending spline grooves 334 in the overshot member 300. Thus, rotation of the overshot member 300 translates into rotation of the sleeve member 304 by virtue of the spline interconnections 332,334. The splines and spline grooves 332,334 co-rotatively and slidably couple the overshot member 300 to the actuating sleeve member 304. The threads 310,311 are a five start thread form which causes the collar member 314 to move through a greater distance than the travel of the sleeve member 254' in the ball valve. This extra travel insures that prior to opening or closing a ball valve element under pressure, that the locking members 318 remaining locking so that pressure does not blow off the overshot 10.

In operation, when the overshot member 300 is rotated in a left hand direction, the spline and spline groove interconnections 332,334 rotate the inner sleeve member 304 which rotates (in the ball valve assembly) the threaded connection 224' and the vertical movement of the sleeve member 254' rotates the ball valve element 205'. At the same time, the sleeve member 304, by virtue of the inner co-rotative engagement of the slots 320 and the locking finger members 316 rotates the locking collar 314 to release the threaded connection 310,311 between the locking collar 314 and the ball valve housing. The operation of the threaded connection 310,311 between the collar member 315 and the upper member 203' moves the engaged locking members 318 upwardly. At the time that the ball valve element 205' is rotated through a full 90° turn to a fully closed position, the locking members 318 collapse radially inward into the annular recess 330 in the sleeve member 304 so that the overshot housing 300 can be released and removed with an upward pull on the tubing string. In the closed position, the sleeve member 254' engages the shoulder 257' in the member 202' which positively stops the rotation of the ball member. It can be appreciated that the ball valve element must close completely to effect release of the overshot member 300.

A set screw 340 permits adjustment of the spacing of the locking members 318 to the recess 330 so hat the release of the overshot 300 is simultaneous with the full closing of the ball valve element 205'. As soon as the ball valve element completely closes, the overshot 300 and tubing string are free from the ball valve.

To reconnect the overshot member 300 with the sleeve member 304, the overshot member 304 is stabbed onto the sleeve member 304 which interengages the splines 332 with the spline grooves 334. Right hand rotation of the tubing string 12 then rotates the sleeve member 304 and co-rotationally the finger members 316 which screws the collar member 314 on the threaded portion 310. As the threading operation occurs, the locking portions 318 are moved downwardly toward the locking position shown in the drawing. When the overshot is fully connected, further right hand rotation rotates the ball valve element from a closed to an open position.

Figure 16:
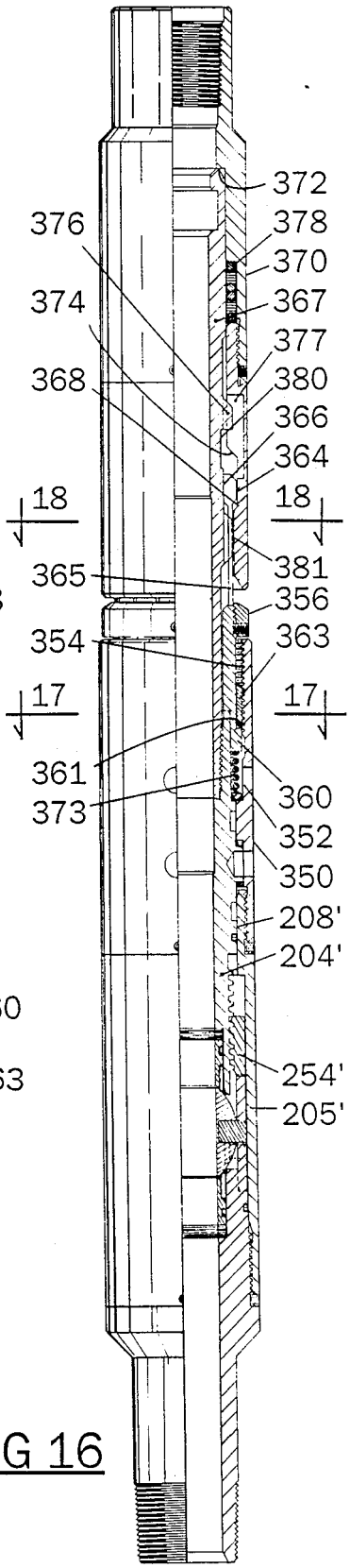
FIG. 16 is a view in partial longitudinal cross section of another embodiment of ball valve and overshot assemblies for simultaneous operation.

Referring now to FIG. 16, in this embodiment the ball valve assembly includes a ball valve element 205' as described before, where the ball valve element is rotatively actuated between open and closed positions by longitudinal linear movement of an actuating sleeve member 254'. The longitudinal linear movement of the sleeve member 254' is produced by rotation of a rotatable actuating member 204'.

The rotatable actuating member 204' has a flange member 208' rotatably mounted within a tubular upper member 350 attached to the ball valve assembly. The upper end of member 350 defines a tubular annulus 352 with respect to the actuating member 204'. The upper end of the tubular upper member 350 also has an internal thread 354. The upper end of the actuating member 204' slidably receives the lower tubular end of a latching member 360. The latching member 360 has an outwardly extending flange portion 356. There are vertical keys 358 (see FIG. 17) angularly disposed from one another about the circumference of the latching member 360. A nut member 363 is slidably and non-rotatively mounted by the keys 358 to the latching member 360. The nut member 363 is threadedly connected to the thread 354 and contained on the latching member 360 by the flange portion 356 and a lower end portion 361. A tubular latching member 360 is disposed within the tubular annulus 352. The lower end portion 361 of the latching member 360 compresses a spring member 373.

The latching member 360 has upwardly extending strap members 365 which are slidably received in vertical slots 358 and which have enlarged terminal locking portions 364. The enlarged locking portions 364 are disposed between an outer surface 366 on a rotatable member 367 (coupled to member 204') and an annular locking recess 368 in a tubular overshot member 370. The inter-engagement of the locking portions 364 and the annular locking recess 368 initially locks the tubular overshot member 370 to the rotatable member 367.

The tubular overshot member 370 includes a first lower downwardly facing shoulder 372 and a second upper downwardly facing shoulder 374. The upper end of the rotatable member 367 is in engagement with the upper downwardly facing shoulder 372 in the position shown in the drawing.

The lower downwardly facing shoulder 374, in the position shown in the drawing, is located just above the locking portions 364 on the latching member 360. Seal means 378 are located in the tubular overshot member 370 between the upper and lower downwardly facing shoulders 372,374.

On the rotatable member 367 just above the locking portions 364 is an annular release groove 380 for receiving and releasing the enlarged locking members 364 from a locking relationship with the member 370. The enlarged members 364 are moved upwardly relative to the rotatable member 367 to the release groove 380 by rotation of the tubular overshot member 370. The tubular overshot member 370, when rotated, has spline groove 377 which engage spline members on an annular flange 376 and rotate the rotatable member 367 to rotate the ball valve element between the stop positions for the open and closed positions.

Rotation of the rotatable member 367 also rotates the strap members 365 in key slots 381 and the threaded nut member 363 is unscrewed from the threads 354 in the upper member 350. The threaded motion produces an upward longitudinal movement of the latching member 360 and the enlarged locking members 364. The relationship of the threads on the tubular member 360 relative to the threads on the ball actuator member 254' is such that as the ball element reaches the end of its rotative positioning, the locking members 364 reach the release groove 380 and release the overshot member 370. The upward movement of the tubular member 360 is assisted by the spring member 373. Preferably, the threads are left handed so that left hand rotation rotates the ball valve element between an open and a closed position while simultaneously releasing the overshot member.

The overshot can be reconnected by tabbing the tubular overshot housing 370 on the tubular member 367 so that the enlarged locking members 364 spring into the annular locking recess 368. Thus, when the tubular housing member 370 is moved downwardly by rotation, the threaded nut member 363 is recoupled and the spring member 373 is recompressed. Thus, the overshot member 370 can be reset to the position shown in the drawing.

It will be apparent to those skilled in the art that various changes may be made in the invention without departing from the spirit and scope thereof and therefore the invention is not limited by that which is enclosed in the drawings and specifications, but only as indicated in the appended claims.

We claim:

1. A mechanical set packer for use in a well casing comprising:

a tubular supporting mandrel adapted for coupling to a string of pipe for movement in longitudinal and rotative directions, a first packer assembly disposed on said supporting mandrel and including interconnected and longitudinally slidable elements, said slidable elements being movable between an extended condition and a contracted condition and including wall engaging means for frictionally engaging the wall of a well casing, said slidable elements further including a packer element as well as upper and lower slip expander elements and intermediately located slip elements where said slip elements are co-operable with said slip expander elements in said contracted condition for engaging a well casing, said slidable elements further including a slip cage assembly for slidably coupling said slip elements and said slip expander means to one another, said wall engaging means being coupled to said upper slip expander element, release means for releasably coupling said slidable elements to said supporting mandrel in said extended condition for passage through a well casing, said release means being operative upon rotative manipulation of said supporting mandrel while said wall engaging means frictionally engages a well casing for releasing said slidable elements with respect to said supporting mandrel and for permitting said slidable elements to be moved to said contracted condition on said supporting mandrel, said release means including a lug on said upper slip expander element and a recessed slot in said supporting mandrel for releasably interlocking said supporting mandrel and said upper slip expander element in a first position and preventing relative movement to a second position while moving said packer in a well casing, and for releasing said supporting mandrel relative to said upper slip expander element by a co-operative relative rotative and longitudinal motion for permitting movement of said supporting mandrel relative to said slip expander element and for moving said slidable elements from an extended condition to a contracted condition and for setting the packer element in a well casing in said contracted condition, second release means for releasably retaining said slidable elements in a contracted condition on said supporting mandrel, said second release means being released by rotation of the supporting mandrel for relative movement of said supporting mandrel and said interconnected elements to the extended condition, said lug being axially movable and spring biased toward said supporting mandrel for resetting said lug in said recessed slot by relative longitudinal movement of the supporting mandrel relative to the upper slip expander element.

2. A packer as set in claim 1 wherein said recessed slot is formed in an enlarged diameter portion of said supporting mandrel and said enlarged diameter portion is located above a smaller diameter portion, and where said recessed slot has a release slot portion arranged for a opening to said smaller diameter portion so that said lug is releasable from said recessed slot by passing through said release slot portion.

3. The packer as set forth in claim 2 wherein said enlarged diameter portion and said smaller diameter portion are interconnected with an annular inclined surface for guiding said lug to a reset position in said recessed slot upon relative longitudinal motion.

4. The packer as set forth in claim 1 wherein said recessed slot has a retainer slot portion with an opening to said release slot portion, said retainer slot portion extending circumferentially about said supporting member between said release slot portion and a closed end surface whereby said lug is confined in said retainer slot portion except when said lug is in alignment with said release slot portion for release from said recessed slot by relative longitudinal movement.

5. The packer as set forth in claim 2 wherein said recessed slot has a circumferentially extending portion with a downwardly facing surface disposed in a plane transverse to a central axis for the supporting mandrel and an upwardly facing surface disposed at an angle to a plane transverse to a central axis for the supporting mandrel and wherein the upwardly facing surface joins a stop surface located adjacent to said release slot portion.

6. The packer as set forth in claim 5 wherein said recessed slot includes a slot portion generally parallel to a central longitudinal axis for the supporting mandrel.

7. A mechanical set packer for use in a well casing comprising:

a tubular supporting mandrel adapted for coupling to a string of pipe for movement in longitudinal and rotative directions, a first packer assembly disposed on said supporting mandrel and including interconnected and longitudinally slidable elements, said slidable elements being movable between an extended condition and a contracted condition and including wall engaging means for frictionally engaging the wall of a well casing, said slidable elements further including a packer element as well as upper and lower slip expander elements and intermediately located slip elements where said slip elements are co-operable with said slip expander elements in said contracted condition for engaging a well casing, said slidable elements further including a slip cage assembly for slidably coupling said slip elements and said slip expander means to one another, said wall engaging means being coupled to said upper slip expander element, release means for releasably coupling said slidable elements to said supporting mandrel in said extended condition for passage through a well casing, said release means being operative upon rotative manipulation of said supporting mandrel while said wall engaging means frictionally engages a well casing for releasing said slidable elements with respect to said supporting mandrel and for permitting said slidable elements to be moved to said contracted condition on said supporting mandrel, said release means including a lug on said upper slip expander element and a recessed slot in said supporting mandrel for releasably interlocking said supporting mandrel and said upper slip expander element in a first position and preventing relative movement to a second position while moving said packer in a well casing, and for releasing said supporting mandrel relative to said upper slip expander element by a co-operative relative rotative and longitudinal motion for permitting movement of said supporting mandrel upwardly relative to said slip expander element and for moving said slidable elements from an extended condition to a contracted condition and for setting the packer element in a well casing in said contracted condition, second release means for releasably retaining said slidable elements in a contracted condition on said supporting mandrel, said second release means including resiliently biased, threaded clutch nut members disposed in said upper slip expander element in facing relationship to said supporting mandrel and a thread portion on said supporting mandrel being released by rotation of the threaded portion on said supporting mandrel relative to said nut members for relative movement of said supporting mandrel and said interconnected elements to the extended condition, said lug being axially movable and spring biased toward said supporting mandrel for resetting said lug in said recessed slot by relative longitudinal movement of the supporting mandrel relative to the upper slip expander element.

8. A mechanical set packer for use in a well casing comprising:

a tubular supporting mandrel adapted for coupling to a string of pipe for movement in longitudinal and rotative directions, a first packer assembly disposed on said supporting mandrel and including interconnected and longitudinally slidable elements, said slidable elements being movable between an extended condition and a contracted condition and including wall engaging means for frictionally engaging the wall of a well casing, said slidable elements including an upper expander element, friction means on said upper expander element for frictionally engaging the wall of a well casing, a cage member slidably coupled to said upper expander element, slip elements carried by said cage member and mounted for relative radial movement, a lower expander element slidably coupled to said cage member, a packer element support member slidably coupled to said lower expander element, a packer element disposed on said packer element support member, release means for releasably coupling said upper expander element to said supporting mandrel in said extended condition for passage through a well casing, said release means being operative upon rotative and longitudinal manipulation of said supporting mandrel while said wall engaging means frictionally engages a well casing for releasing said upper expander element with respect to said supporting mandrel and for permitting said slidable elements to be moved to said contracted condition on said supporting mandrel, said release means including a lug on said upper slip expander element and a recessed slot in said supporting mandrel for releasably interlocking said supporting mandrel and said upper slip expander element in a first position and preventing relative movement to a second position while moving said packer in a well casing, and for releasing said supporting mandrel relative to said upper slip expander element by a co-operative relative rotative and longitudinal motion for permitting movement of said supporting mandrel relative to said slip expander element and for moving said slidable elements from an extended condition to a contracted condition and for setting the packer element in a well casing in said contracted condition, second release means for releasably retaining said slidable elements in a contracted condition on said supporting mandrel by releasably connecting said supporting mandrel to said upper expander element, said second release means being released by rotation of the supporting mandrel for relative movement of said supporting mandrel and said interconnected elements to the extended condition, a lower coupling member located below said packer element, and means for rotatively coupling said lower coupling member to said supporting mandrel.

9. The packer as set forth in claim 8 wherein said means for rotatively coupling includes a bearing means between said supporting mandrel and said lower coupling member.

10. The packer as set forth in claim 9 wherein said means for rotatively coupling includes a circularly shaped shear member rotatively interconnecting said supporting mandrel to said lower coupling member.

11. The packer as set forth in claim 10 and further including shoulder means on said supporting mandrel for independently engaging with said upper expander element and said lower coupling member for retrieving said packer by shearing said circularly shaped shear member.

12. The packer as set forth in claim 8 wherein said supporting mandrel has a downwardly facing surface in engagement with said packer element support member and said packer element support member has a downwardly facing surface in engagement with the lower expander element for preventing in said extended condition for maintaining said lower expander element separated from said slip elements.

13. A tubing operated ball valve system for use in a well casing where the ball valve system has a flow passageway extending along a central axis and a generally spherical ball valve element disposed in said flow passageway for rotative movement between open and closed positions and is rotative about an axis transverse to the central axis of the flow passageway, said ball valve system including an upper rotatable tubular inner member and a tubular lower housing member respectively having upper and lower attaching means for coupling to an upper string of manipulating tubing and to a lower immovable tubular member in a well casing, valve means disposed between said tubular upper inner member and said lower housing member and including said generally spherically shaped ball valve element with a flow opening for alignment with said flow passageway in said upper inner member and said lower housing member in a first rotative position of said ball valve element and with at least one surface portion for closing off the flow passageway in a second rotative position of said ball valve element, annular sealing means in at least one of said upper inner member and said lower housing member for sealing engagement with at least on surface portion in said second rotative position and for defining a closed position, means in said tubular lower housing member for rotatively supporting said ball valve element for rotation about an axis transverse to the central axis of said flow passageway, an actuator sleeve member disposed between said upper inner member and said lower housing member, driver means on said actuator sleeve member coupled between said ball valve element and said sleeve member for rotating said ball member upon longitudinal movement of said sleeve member relative to said tubular lower housing member, actuator means on said actuator sleeve member including threaded portions co-operative with said upper inner member for producing longitudinal movement of said actuator sleeve member relative to said ball valve element, said inner member and said lower housing member in response to rotation of said inner member.

14. The ball valve system as set forth in claim 13 wherein said means for rotatively supporting said ball valve element includes slot openings diametrically located in said lower housing member, pivot pin block members respectively disposed in said slot openings, and pivot pin members on said pivot pin blocks disposed in pivot sockets in said ball valve element.

15. The ball valve system as set forth in claim 13 wherein said ball valve element has external, oppositely disposed, turning slots arranged to cooperate with lug members for rotating the ball valve element about a transverse axis when said lug members are moved in a direction parallel to said central axis, and said driver means including said lug members disposed in said turning slots.

16. The ball valve system as set forth in claim 13 wherein said driver means is longitudinally movable between stop members respectively at a first longitudinal position where said ball valve element is in a first rotative position and at a second longitudinal position where said ball valve element is in a second rotative position.

17. The ball valve system as set forth in claim 13 wherein said upper inner member is disposed in an upper housing member having a recess, said upper inner member having a flange portion rotatively disposed within said recess between upper and lower bearing means, and upper and lower bearing and centralizing elements respectively disposed above and below said bearing means for centrally containing said bearing means within said upper housing member.

18. The ball valve system of claim 15 wherein said lug members have parallel side surfaces for sliding in cross sectional rectangularly shaped turning slots and have pivot pin members rotatively received in bores in said actuator sleeve member.

19. A tubing operated valve system for use in a well casing where the valve system has a flow passageway and a valve element with a spherical surface portion disposed in said flow passageway for rotative movement between open and closed positions by rotation about an axis transverse to the axis of the flow passageway, said valve system including an upper rotatable tubular inner member and a tubular lower housing member respectively having upper and lower attaching means for coupling to an upper string of manipulating tubing and to a lower immovable tubular member in a well casing, valve means disposed between said tubular upper inner member and said lower housing member and including said valve element where said valve element has a flow opening for alignment with said flow passageway in said upper inner member and said lower housing member in a first rotative position of said ball valve element and has a spherical face portion for closing off the flow passageway in a second rotative position of said valve element, annular sealing means disposed between said upper inner member and said lower housing member for sealing engagement with said spherical surface portion in said second rotative position and defining a closed position, means in said tubular lower member for rotatively supporting said valve element for rotation about an axis transverse to the central axis of said flow passageway, actuator means including an actuator sleeve member co-operately coupled between said valve element, said lower housing member and said inner member for rotating said valve element upon longitudinal movement of said actuator sleeve member relative to said tubular lower housing member where such longitudinal movement of said sleeve member is produced in response to rotation of said inner member relative to said lower housing member, said actuator means including a threaded connection between said actuator sleeve member and said inner member.

20. The ball valve system as set forth in claim 19 wherein said means for rotatively supporting said ball valve element includes slot openings diametrically located in said lower housing member, pivot pin block members respectively disposed in said slot openings, and pivot pin members on said pivot pin blocks disposed in pivot sockets in said ball valve element.

21. The ball valve system as set forth in claim 19 wherein said ball valve element has external, oppositely disposed, turning slots arranged to cooperate with lug members for rotating the ball valve element about a transverse axis when said lug members are moved in a direction parallel to said central axis, and said actuator means including said lug members disposed in said turning slots.

22. The ball valve system as set forth in claim 19 wherein said actuator means is longitudinally movable between stop members respectively at a first longitudinal position where said ball valve element is in a first rotative position and at a second longitudinal position where said ball valve element is in a second rotative position.

23. The ball valve system as set forth in claim 19 wherein said upper inner member is disposed in an upper housing member having a recess, said upper inner member having a flange portion rotatively disposed within said recess between upper and lower bearing means, and upper and lower bearing and centralizing elements respectfully disposed above and below said bearing means for said centrally containing bearing means within said upper housing member.

24. The ball valve system cf claim 21 wherein said lug members have parallel side surfaces for sliding in cross sectional rectangularly shaped turning slots and have pivot pin members rotatively received in bores in said actuator sleeve member.

25. A tubing operated ball valve system for use in a well casing where the ball valve system has a flow passageway extending along a central axis and a generally spherical ball valve element disposed in said flow passageway for rotative movement between open and closed positions and is rotative about an axis transverse to the central axis of the flow passageway, said ball valve system including a tubular housing member, an upper rotatable tubular inner member rotatively disposed in said tubular housing member, said inner member and said housing member respectively having upper and lower attaching means for coupling to an upper string of manipulating tubing and to a lower immovable tubular member in a well casing, means for rotatively mounting said inner member in said housing member in a fixed longitudinal and rotative relationship, a generally spherically shaped ball valve element with a flow opening for alignment with said flow passageway and disposed between said upper inner member and said tubular housing member, sealing means on said inner member and said tubular housing member for sealingly engaging with surface portions on said ball valve element for closing off the flow passageway in a second rotative position of said ball valve element, means in said tubular housing member for rotatively supporting said ball valve element for rotation about an axis transverse to the central axis of said flow passageway, an actuator sleeve member disposed between said upper inner member and said housing member, means for preventing relative rotation of said actuator sleeve member to said housing member and for permitting only longitudinal movement of said actuator sleeve member and means for limiting relative longitudinal movement of said actuator sleeve member between first and second longitudinal positions, driver means on said actuator sleeve member coupled between said ball valve element and said actuator sleeve member for rotating said ball member between said first and second rotative positions in response to longitudinal movement of said sleeve member relative to said tubular lower housing member between said first and second longitudinal positions, actuator means on said actuator sleeve member including threaded portions co-operative with said upper inner member for producing longitudinal movement of said actuator sleeve member relative to said housing member between said first and second longitudinal positions in response to rotation of said inner member.

26. The ball valve system as set forth in claim 25 wherein said means for rotatively supporting said ball valve element includes slot openings diametrically located in said lower housing member, pivot pin block members respectively disposed in said slot openings, and pivot pin members on said pivot pin blocks disposed in pivot sockets in said ball valve element.

27. The ball valve system as set forth in claim 25 wherein said ball valve element has external oppositely disposed, turning slots arranged to cooperate with lug members for rotating the ball valve element about a transverse axis when said lug members are moved in a direction parallel to said central axis, and said driver means including said lug members disposed in said turning slots.

28. The ball valve system as set forth in claim 25 wherein said means for rotatively coupling includes a flange member disposed in a recess between bearing means and bearing centralizer means located above and below the bearing means.

29. The ball valve system as set forth in claim 25 wherein said sealing means includes a socket for receiving a tubular seating member constructed of metal and retaining an annular elastomer sealing element for contact with said ball valve element, resilient means in said socket for resiliently urging a sealing element into contact with a ball valve element, and sealing means disposed between said seating member and said socket.

30. A tubing operated ball valve system for use in a well casing where the ball valve system has a flow passageway extending along a central axis and a generally spherical ball valve element disposed in said flow passageway for rotative movement between open and closed positions and is rotative about an axis transverse to the central axis of the flow passageway, said ball valve system including an upper rotatable tubular inner member and a tubular lower housing member: said inner member having attaching means for releasable coupling to an upper overshot member and said housing member having attaching means for coupling to a lower immovable tubular member in a well casing, valve means disposed between said tubular upper inner member and said lower housing member and including said generally spherically shaped ball valve element with a flow opening for alignment with said flow passageway in said upper inner member and said lower housing member in a first rotative position of said ball valve element and with at least one surface portion for closing off the flow passageway in a second rotative position of said ball valve element, annular sealing means in at least one of said upper inner member and said lower housing member for sealing engagement with at least one surface portion in said second rotative position and for defining a closed position of the valve means, means in said tubular lower housing member for rotatively supporting said ball valve element for rotation about an axis transverse to the central axis of said flow passageway, an actuator sleeve member disposed between said upper inner member and said lower housing member, driver means on said actuator sleeve member coupled between said ball valve element and said sleeve member for rotating said ball member upon longitudinal movement of said actuator sleeve member relative to said tubular lower housing member, actuator means on said actuator sleeve member including threaded portions co-operative with said upper inner member for producing longitudinal movement of said actuator sleeve member relative to said ball valve element, said inner member and said lower housing member in response to rotation of said inner member, said overshot means including a tubular overshot housing for coupling to a manipulating string of tubing and for releasably coupling to said ball valve system, latching means for releasably latching said overshot housing to said lower housing member, said latching means being longitudinally movable between a first and second longitudinal positions of said latching means, release means on said inner member for releasing said latching means upon longitudinal movement of said latching means to its second longitudinal position, co-rotative means in said overshot means for co-rotatively coupling said latching means and said inner member to said overshot housing so that rotation of said overshot housing rotates said inner member and said latching means yet permits relative longitudinal movement of said latching means, thread means for threadedly coupling said latching means to said lower housing member for longitudinal movement so that when said latching means is in said second longitudinal position, said ball valve element is in said second rotative position.

31. The ball valve system as set forth in claim 30 wherein said overshot housing has sealing means located above said latching means for sealing off said housing member relative to said inner member.

32. The ball valve system as set forth in claim 30 wherein said co-rotative means includes spline members interfitting with spline grooves.

33. The ball valve system as set forth in claim 30 wherein said latching means includes collet fingers and said thread means includes a threaded member where said threaded member and collet fingers are coupled to one another, said co-rotative means including spline grooves for slidably but non-rotatively coupling said inner member to said collet fingers,

34. A ball valve and overshot system for use in a well bore whereas the overshot is connectable to a string of tubing and the ball valve is connectable in fixed relationship to the well bore and the overshot is disconnectable and connectable by manipulation of a tubing string and the ball valve is operable in response to tubing manipulation when the overshot is connected, the combination including:

ball valve means having a flow passageway and a ball valve element for opening said passageway in a first rotative position and closing said passageway in a second rotative position, a rotatable member in said ball valve means for moving said ball valve element between said first and second rotative positions in response to rotation of said rotatable member, said ball valve means having a latching mechanism coaxially disposed on said rotatable member and having a first threaded connection to said ball valve means for moving said latching mechanism longitudinally along said rotatable member, an overshot means having a tubular overshot housing for receiving the upper end of said rotatable member and the latching mechanism, said tubular overshot housing being co-rotatable with said rotatable member, said latching mechanism being co-rotatively interconnected with said rotatable member and longitudinally movable between a first latching position and a second release position, said rotatable member having a release portion cooperable with said latching mechanism so that said latching mechanism releases said tubular overshot housing from said rotatable member in said second release position whereby rotation of said rotatable member in one rotational direction rotates the rotatable member and moves the ball valve element between its rotative positions and simultaneously rotates the latching mechanism between a first latching position and a second release position.

35. The ball valve and overshot system as set forth in claim 34 wherein said latching mechanism includes collet fingers with locking elements and said release portion includes a recessed area on said rotatable member for receiving said locking element.

36. The ball valve and overshot system as set forth in claim 35 and further including means for adjusting the span of movement of said latching mechanism between said first latching position and said second release position.

37. The ball valve and overshot system as set forth in claim 34 wherein said ball valve means includes a second threaded connection for moving said ball valve element between said first and second rotative positions.

38. The ball valve and overshot system as set forth in claim 37 wherein said second threaded connection and said first threaded connection require but one turn of said overshot housing for moving said ball valve element between said first and second rotative positions and for moving said latching mechanism between said first latching position and a second release position.

39. A ball valve, an overshot and a packer system for use in a well bore where the overshot is connectable to a string of tubing and the ball valve is connectable to a packer and the ball valve, the overshot and the packer are operable by manipulation of a tubing string and the ball valve is operable in response to tubing manipulation when the overshot is connected, the combination including:

packer means for sealing off a well bore, said packer means having a rotatable and longitudinally movable, tubular supporting member movable between a first longitudinal position where said packer means is in an unset condition and a second longitudinal position where the packer means is in a set condition and seals off the well bore, said packer means being releasable from a set condition by right hand rotation of the tubular supporting member and release of a threaded interconnection in the packer means, ball valve means having a tubular housing attached to said tubular supporting member, a flow passageway, a ball valve element for opening said passageway in a first rotating position and closing said passageway in a second rotative position, and a rotatable member for moving said ball valve element between said first and second rotative positions in response to rotation of said rotatable member, said rotatable member and said tubular housing being co-rotatable in said first and second rotative positions of said ball valve element, said ball valve means having a latching mechanism coaxially disposed on said rotatable member, and having threaded connection to said ball valve means for moving said latching mechanism longitudinally along said rotatable member, an overshot means having a tubular overshot housing for receiving the upper end of said rotatable member and the upper end of the latching mechanism, said tubular overshot housing being co-rotatable with said rotatable member, said latching mechanism being co-rotatively interconnected with said rotatable member and longitudinally movable between a first latching position and a second release position, said rotatable member having a release portion cooperable with said latching mechanism so that said latching mechanism releases said tubular overshot housing from said rotatable member in said second release position whereby rotation of said rotatable member on a left hand direction rotates the rotatable member and moves the ball valve element from an open to a closed position and simultaneously rotates the latching mechanism between a first latching position and a second release position.

40. The system as set forth in claim 39 wherein said ball valve means includes a threaded connection for moving said ball valve element between said first and second rotative positions and wherein said latching mechanism reaches said second release position at the time said ball valve element fully reaches one of its rotative positions.

41. A method of operating a well tool in a well bore by longitudinal and rotative manipulation of a string of tubing where the well tool includes a first device which has a supporting member which is operable in response to longitudinal movement to move from an unset condition relative to a well bore to a set condition where the first device is releasably attached to the well bore, and is operable in response to rotation of said supporting member in a first rotative direction for moving to an unset condition, a second device which has a housing member attached to the supporting member and a rotatable member which can be rotated in a second rotative direction opposite to said first rotative direction to move from a first engaged relationship with the housing member to a second engaged relationship and can be rotated in the first rotative direction from the second engaged relationship to the first engaged relationship, a third device which is releasably attached to said rotatable member and which can be released from said rotatable member by rotation in said second rotative direction and can be recoupled by rotation in said first rotative direction, the method including the steps of coupling said first, second and third devices to one another and lowering said first, second and third devices on a string of tubing into a well bore to a desired location, moving said string of tubing in a longitudinal direction upwardly to move said first device from an unset condition to a set condition, rotating said string of tubing in said second rotative direction for rotating the rotatable member from the first engaged relationship to said second engaged relationship and for co-rotating a release mechanism on said second device from a locking condition to a release condition to occur simultaneously with the occurrence of one of said engaged relationships.

42. The method as set forth in claim 41 and further including the step of removing the string of tubing and said third device from the well bore.

43. The method as set forth in claim 42 and further including the step of lowering a string of tubing and a third device into the well bore and upon said second device receiving said third device, rotating said third device in said first rotative direction for reconnecting said third device to said second device and for rotating the rotatable member from the second engaged relationship to said first engaged relationship.

44. The method as set forth in claim 43 and further including the step of continuing of rotation of said string of tubing in a first rotative direction for moving said first device to an unset condition.

45. The method as set forth in claim 41 when said first device is also operable in response to tension for moving to an unset condition, and further including the step of applying tension to said string of tubing for moving said first device to an unset condition.

46. In a well tool for use in a well bore traversing earth formations where simultaneous rotation and relative movement of well tool members is required, said well tool including:

first, second and third independent tubular members disposed in a co-axial relationship to one another where said third tubular member is disposed in an annulus between said first and said second tubular members, said third tubular member having movable locking collet portions for cooperation with locking surfaces on said first and said second tubular members, first engaging means for co-rotatively engaging said first tubular member and said second tubular member to one another in a first longitudinal position for co-rotation and for permitting relative longitudinal movement of said second tubular member to a second longitudinal position where said first engaging means are disengaged, said locking collet portions cooperating with said locking surfaces to releasably lock said first and second tubular members in said first longitudinal position, second engaging means for co-rotatively engaging said third tubular member and said first tubular member to one another for co-rotation and for permitting longitudinal movement of said third tubular member relative to said first tubular member for moving said locking collet portions to an unlocking position relative to said second tubular member so that said second tubular member can be moved to said second longitudinal position.

47. The well tool as defined in claim 46 wherein said third tubular member has a threaded connection with respect to the well tool for moving said locking collet fingers to an unlocking position in response to rotation of said third tubular member relative to the well tool.

48. The well tool as defined in claim 47 wherein said second tubular member is released from said first tubular member and said second tubular member in said second longitudinal condition.

* * * * *